US005274344A

United States Patent [19]

Langer et al.

[11] Patent Number: 5,274,344

[45] Date of Patent: Dec. 28, 1993

[54] BRANCH SEPARATING FILTER

[75] Inventors: Wolfgang Langer, Munich; Gerhard Pfitzenmaier, Groebenzell; Klaus Vogel, Geretsried; Walter Meier, Altdorf, all of Fed. Rep. of Germany

[73] Assignee: Siemens Aktiengesellschaft, Munich, Fed. Rep. of Germany

[21] Appl. No.: 878,912

[22] Filed: May 6, 1992

[30] Foreign Application Priority Data

May 16, 1991 [DE] Fed. Rep. of Germany ..... 4116056

[51] Int. Cl.[5] ..... H01P 1/209

[52] U.S. Cl. ..... 333/135; 333/254; 333/248

[58] Field of Search ..... 333/126, 129, 135, 208, 333/254, 256, 257

[56] References Cited

U.S. PATENT DOCUMENTS

| | | | |
|---|---|---|---|
| 3,428,918 | 2/1969 | Matthaei | 333/135 |
| 4,433,314 | 2/1984 | Hislop et al. | 333/110 |
| 4,614,920 | 9/1986 | Tong | 333/135 |

FOREIGN PATENT DOCUMENTS

| | | |
|---|---|---|
| 3814748 | 9/1989 | Fed. Rep. of Germany . |
| 3928158 | 8/1990 | Fed. Rep. of Germany . |

OTHER PUBLICATIONS

Frequenz; 29 (1975) 9, Von Gerhard Pfitzenmaier "Ein Beitrag zur Optimierung und Realisierung von Hohlleiter-Frequenzweichen", pp. 253-261.

Telcom Report 9 (1986) Sonderheft; Gerhard Ensslin et al "Kanalweichen fur Breitband-Richtfunksysteme", pp. 203-208.

Patent Abstracts of Japan; E-450 Oct. 30, 1986, vol. 10, No. 319, Kazuo Haginuma, "Microwave Band Branching and Combining Device".

Patent Abstracts of Japan; E-577, Jan. 26, 1988, vol. 12, No. 26, Yoji Isoda, "Branching Filter".

*Primary Examiner*—Paul Gensler

*Attorney, Agent, or Firm*—Hill, Steadman & Simpson

[57] ABSTRACT

The disclosed waveguide branch separating filter can be modularly constructed of a basic frequency separating filter and of a filter expansion unit. Both the basic frequency separating filter as well as the filter expansion unit are composed of a reactively terminated (including short circuit) feeder waveguide to which the separating filters are coupled. The expansion of the basic frequency separating filter occurs in largely disturbance-free fashion during operation in that the reactive termination (including short circuit) thereof is mechanically replaced by the filter expansion unit and is electrically simulated during the refitting by a short-circuit plate or by short-circuit pins.

12 Claims, 7 Drawing Sheets

FIG. 6a1
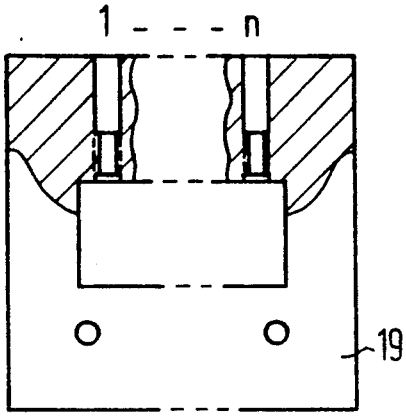
FIG. 6a2
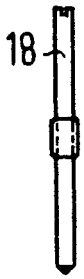
FIG. 6b1
FIG. 6b2
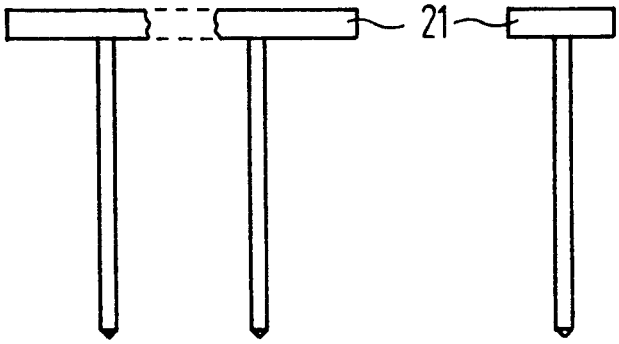
FIG. 6b3
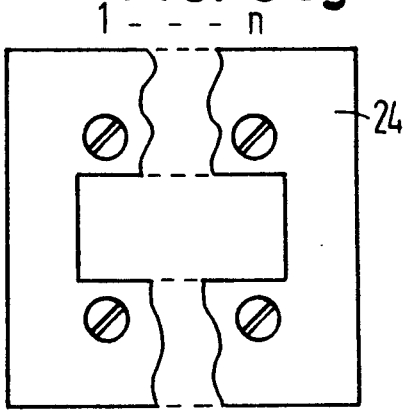
FIG. 6b4
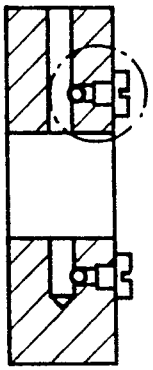
FIG. 6b5
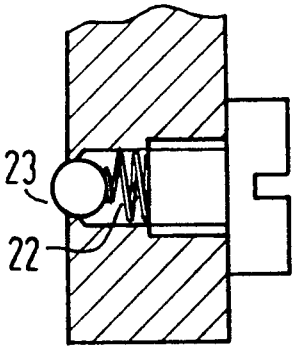

BRANCH SEPARATING FILTER

BACKGROUND OF THE INVENTION

The invention is directed to a branch separating filter in a GHz frequency range, wherein a feeder waveguide is provided which is a plurality of individual filters coupled thereto at electrically significant spacings.

In electrical transmission systems, for example in radio link systems, frequency separating filters are required in the microwave frequency range for reactionless combining or separating of different frequency bands. Critical demands made of these frequency separating filters are: low insertion loss, module structure, no health risk to the personnel due to microwave emission, no interruption in operations when rigging separating filters, and low manufacturing costs.

In addition to containing filters, conventional, modularly constructable chains of channel filters also contain circulators that are relatively expensive, cause undesirably high insertion losses, and can also not always be constructed compactly (Ensslin, G.; Herder, H. H.; Schuster, R.: Kanalweichen fuer Breitband-Richtfunksysterne, telecom report 9 (1986) Sonderheft "Nachrichtenuebertragung auf Funkwegen", pages 203–208). On the other hand, low attenuation and cost-beneficial but not previously modularly constructable frequency separating filters have been disclosed (Pfitzenmaier, G.: Ein Beitrag zur Optimierung und Realisierung von Hohlleiter-Frequenzweichen, Frequenz 29 (1975) 9, pages 253–261). wherein the microwave filters are coupled to a waveguide that is short-circuited at the end ("Manifold Frequency Separating Filter").

SUMMARY OF THE INVENTION

An object of the invention is to specify a branch separating filter in the GHz frequency range wherein the aforementioned difficulties are avoided.

According to the invention, a basic frequency separating filter unit is provided having a plurality of individual filters, each for a different frequency channel. The feederwaveguide of said basic unit is terminated either with a reactive termination or a short circuit. An expansion unit also having a plurality of filters for different frequency channels, and which does not affect operation of the basic frequency filter unit, is also provided which is mateable with the basic frequency separating filter unit during operation thereof. Means is provided for connection of the expansion unit to the basic filter unit without having to take the basic filter unit out of service. The expansion unit is terminated either with a reactive termination or a short circuit.

Figure 7A:
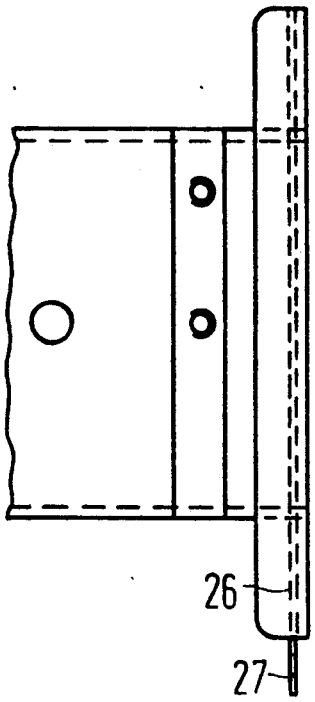
Figure 7B:
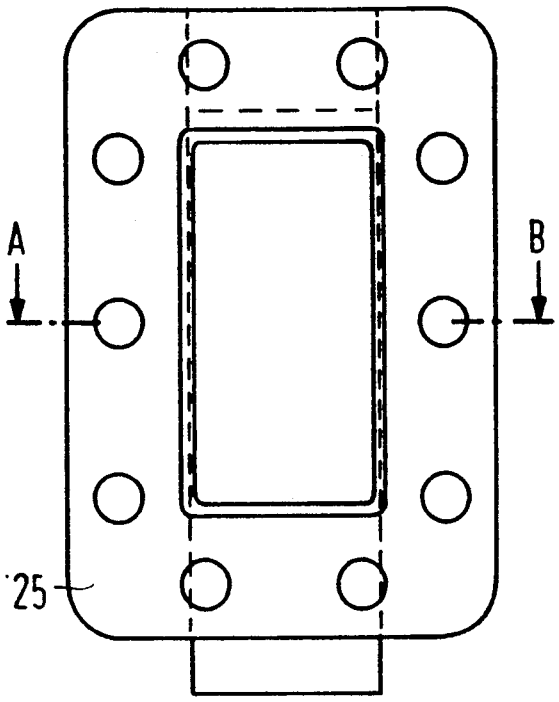
Figure 7C:
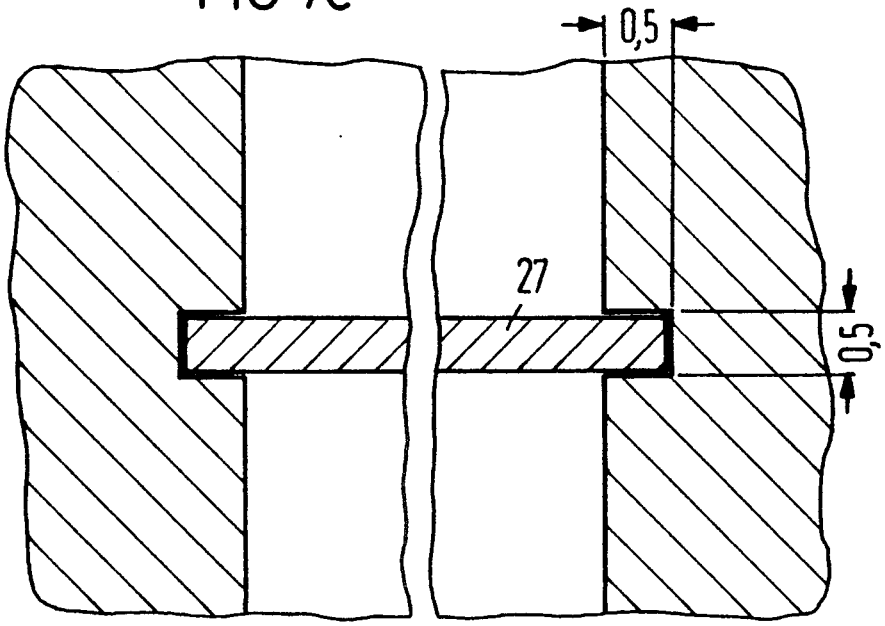

FIGS. $6a_1$, $6a_2$ and $6b_1$, $6b_2$ illustrate an expansion 13 having short-circuit pins (detail);

FIG. $6a_2$ shows threaded pins 18;

FIGS. $6b_1$ and $6a_2$ show a pin plate 21;

FIGS. $6b_3$, $6b_4$ and $6b_5$ show details of the flange of the expansion unit;

FIG. 7*a* illustrates a slot 26 for a short-circuit plate 27;

FIG. 7*b* is a plan view directed to the section shown in FIG. 7*c*; and FIG. 7*c* is a sectional view showing the short-circuit plate 27.

DESCRIPTION OF THE PREFERRED EMBODIMENTS

Figure 1A:
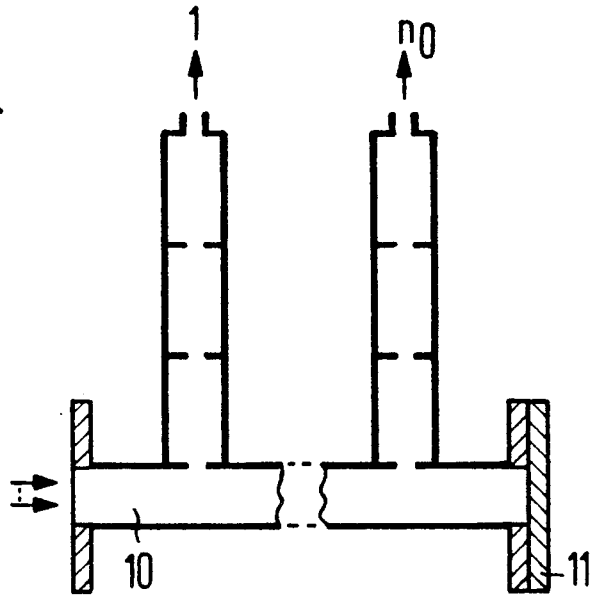
FIGS. 1*a* and 1*b* illustrate a waveguide branch separating filter unit 10 for $n_0$ frequency channels having a short-circuit 11 or reactive termination 12.
Figure 1B:
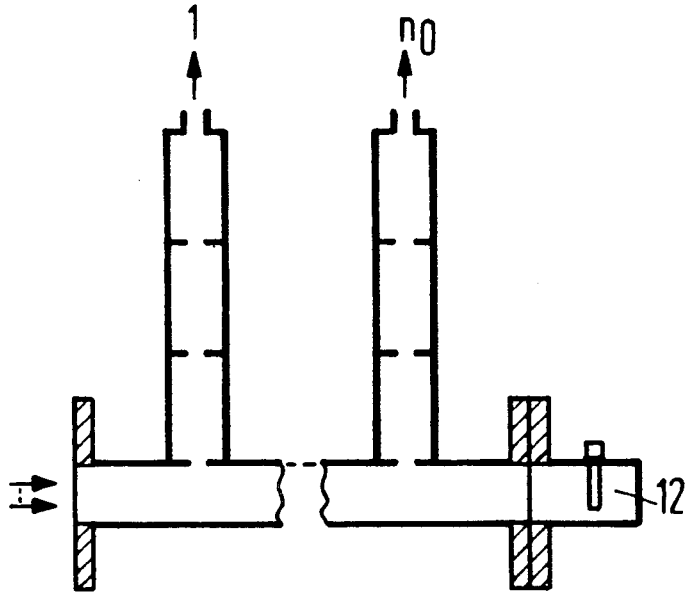
Figure 2:
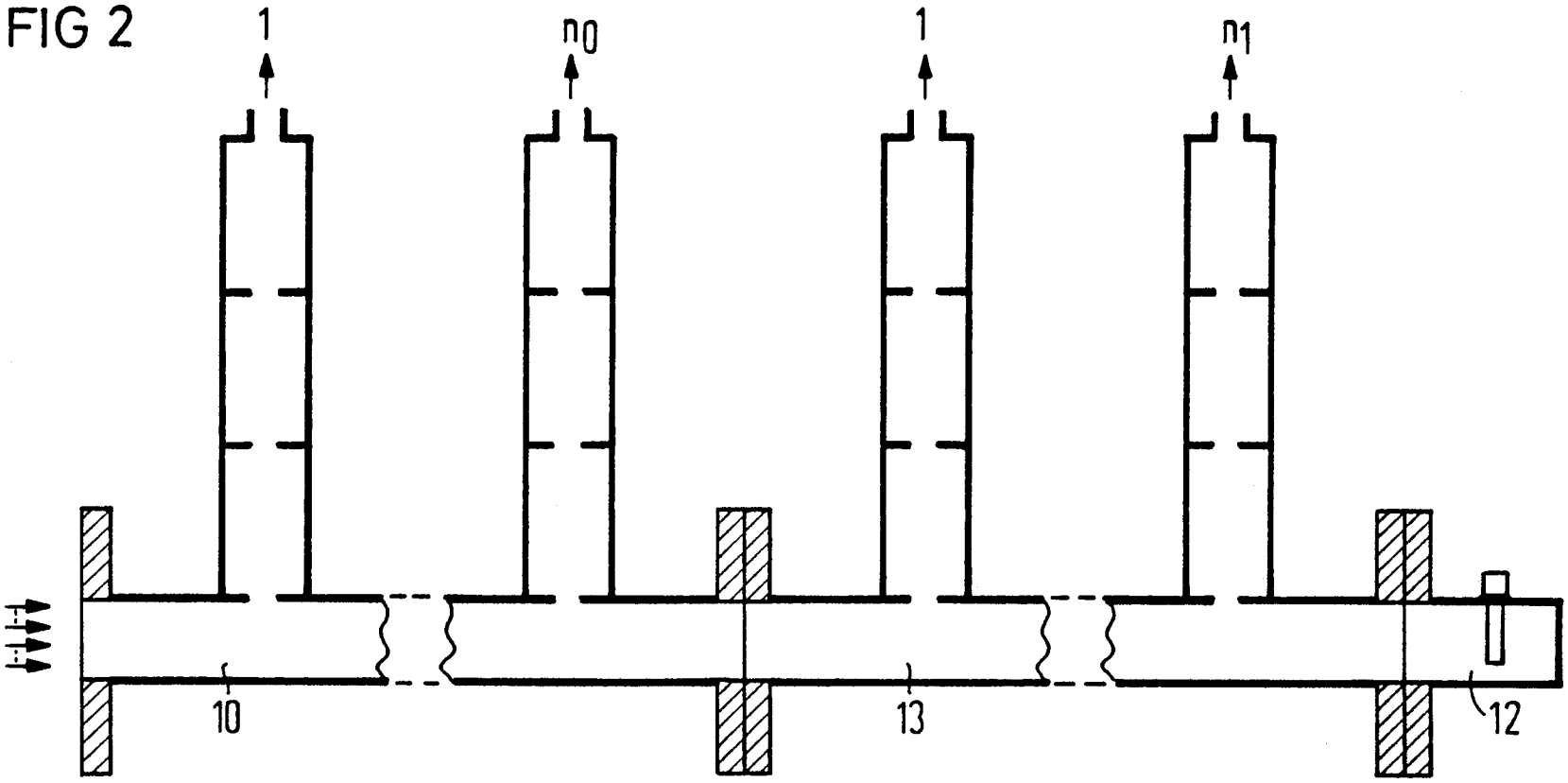
FIG. 2 is a waveguide branch separating filter unit 10 and 13 for $(n_0+n_1)$ frequency channels having a reactive termination 12.

According to the invention, the low-attenuation and cost-beneficial manifold frequency separating filter having $n \geqq 2$ frequency channels can be fundamentally modularly structured in that 1) a reactive termination 12 is provided instead of the conventional short-circuit 11 of the feeder waveguide, as needed (FIGS. 1*a* and 1*b*);
2) for modular expansion of a basic manifold frequency separating filter unit 10 dimensioned for $n_0 \geqq 1$, the current reactive termination 12 or short-circuit 11 of the feeder waveguide is mechanically designed such that it can be removed with simple means and can be replaced by an identical expansion unit 13 of a manifold frequency separating filter for $n_1 \geqq 1$ frequency channels, this expansion unit 13 being in turn already reactively terminated 12 (including short-circuit) and already electrically tuned, and is capable of being replaced such that the electrical tuning of the basic frequency separating filter unit 10 ($n_0$) is entirely or at least approximately preserved (FIG. 2).

With reference to Points 1) and 2), the expansion of the basic frequency separating filter 10 ($n_0$ frequency channels) during the electrical operation thereof to the frequency separating filter having $(n_0+n_1)$ frequency channels occurs according to the invention a) in an extremely short time,
b) electrically disturbance-free to the farthest-reaching extent, and
c) without a hazardous emergence of microwave energy.

Figure 3A:
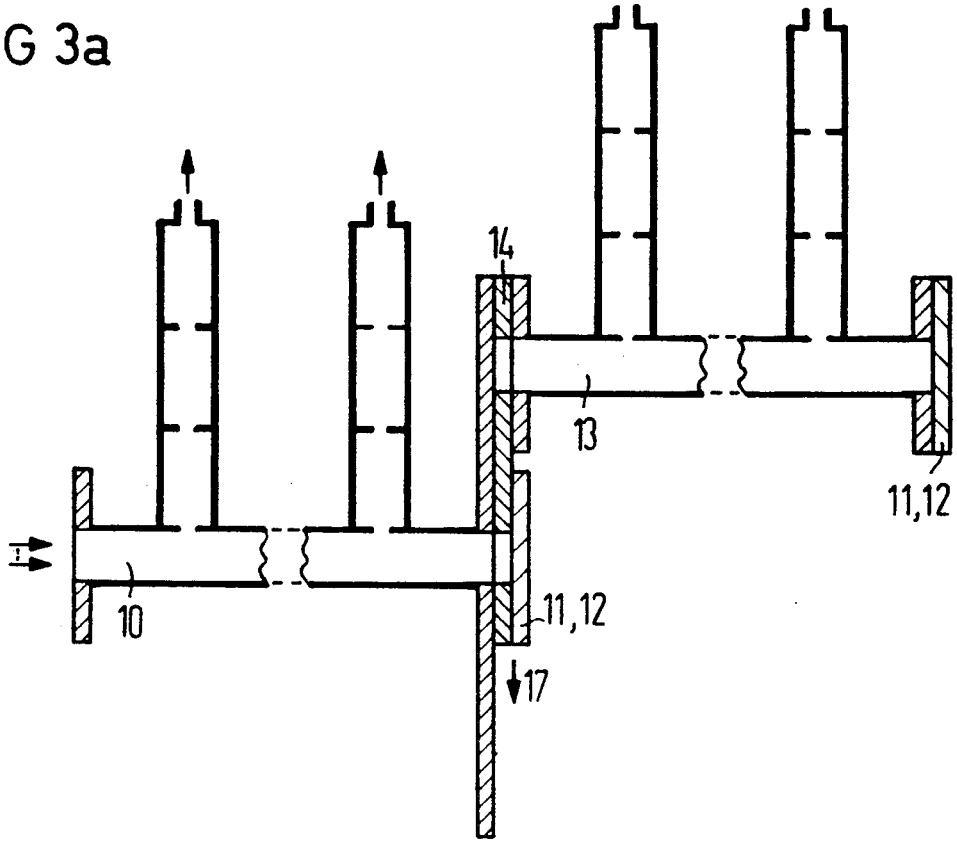
FIGS. 3*a* and 3*b* illustrate an expansion 13 having a carrier plate 14.
Figure 3B:
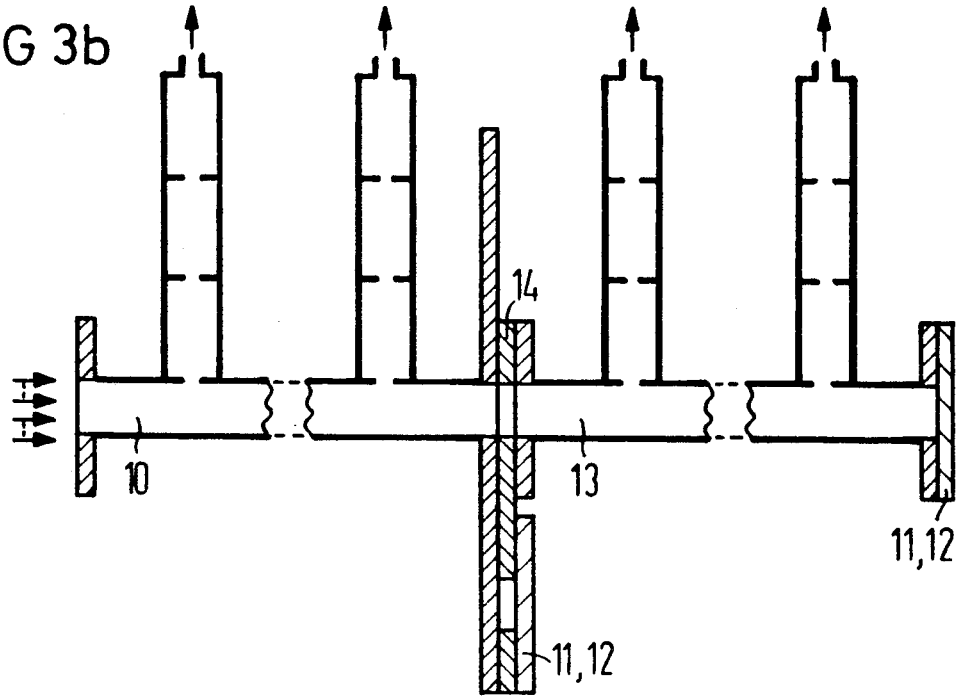

This is because the reactive termination 12 (or short circuit 11) of the feeder waveguide of the basic frequency separating filter 10 ($n_0$ frequency channels) and the expansion unit 13 ($n_1$ frequency channels) having a reactively terminated (or short circuit) feeder waveguide are, mechanically arranged side-by-side on a common carrier plate 14 (FIGS. 3*a* and 3*b*). Alternatively, they are fixed side-by-side by u-shaped rails 15 (FIGS. 4*a* and 4*b*) such that they can interchange their connection positions extremely quickly and precisely by intentional displacement in the manner of, for example, a sliding device. Such a sliding device is known, for example, from semi-mechanical slide projectors. It is assumed that there is a suitable mechanical guide and fixing of the carrier plate 14 or of the u-shaped rails 15. A contact plate or a spring wire at the flange end of the primary feeder waveguide insures constant electrical contact during the displacement event.

It is also especially advantageous that the mounting of the expansion unit 13 ($n_1$ frequency channels) to the carrier plate 14, and the mounting of the u-shaped rails 15, can occur at leisure at any desired point in time.

A basic frequency separating filter unit 10 to which microwave filters 1 through $n_0$ are coupled may be seen in the exemplary embodiment of FIG. 1*a*. Broken lines in the basic frequency separating filter unit 10 indicate that an arbitrary plurality of further filters can be connected therebetween, i.e. that the number $n_0$ is freely selectable and is dependent on the requirements. The energy input is indicated by the double arrow. These symbols are also retained in all other figures. A short circuit 11 with which the basic frequency separating filter 10 is practically terminated may also be seen.

In FIG. 1*b*, this short circuit 11 is replaced by the reactive termination 12; the other symbols are retained in toto.

FIG. 2 shows a manifold frequency separating filter for $(n_0+n_1)$ frequency channels. The basic frequency separating filter unit 10 may be seen; an expansion unit 13 has also been connected in, this being terminated by the above-addressed, reactive termination 12. The numbers 1 through $n_0$, 1 through $n_1$, represent filters or frequency channels.

The basic frequency separating filter unit 10 that is mounted on a carrier plate 14 may be seen in FIGS. 3*a* and 3*b*. It follows the expansion unit 13 that can be previously mounted. The difference between FIGS. 3*a* and 3*b* is that in FIG. 3*a* the short circuit terminates the filter 10, whereas in FIG. 3*b*, the expansion unit has been slid down into alignment with the filter unit 10. The short circuit 11, 12 may again be seen, this being potentially designed as a short circuit or as a reactive termination of the expansion unit 13. The short circuit or reactive termination of the basic frequency separating filter unit 10 are referenced in the same way. Reference numeral 17 indicates a displacement possibility that is merely illustrated as an arrow in the figure.

Figure 4A:
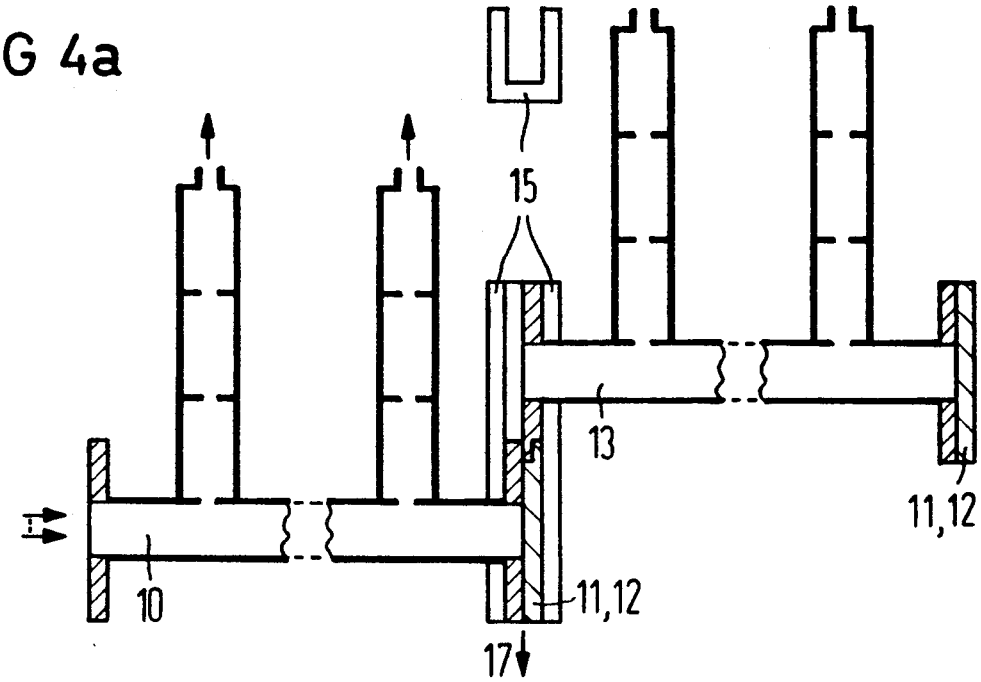
FIGS. 4*a* and 4*b* illustrate an expansion 13 having u-shaped rails 15.
Figure 4B:
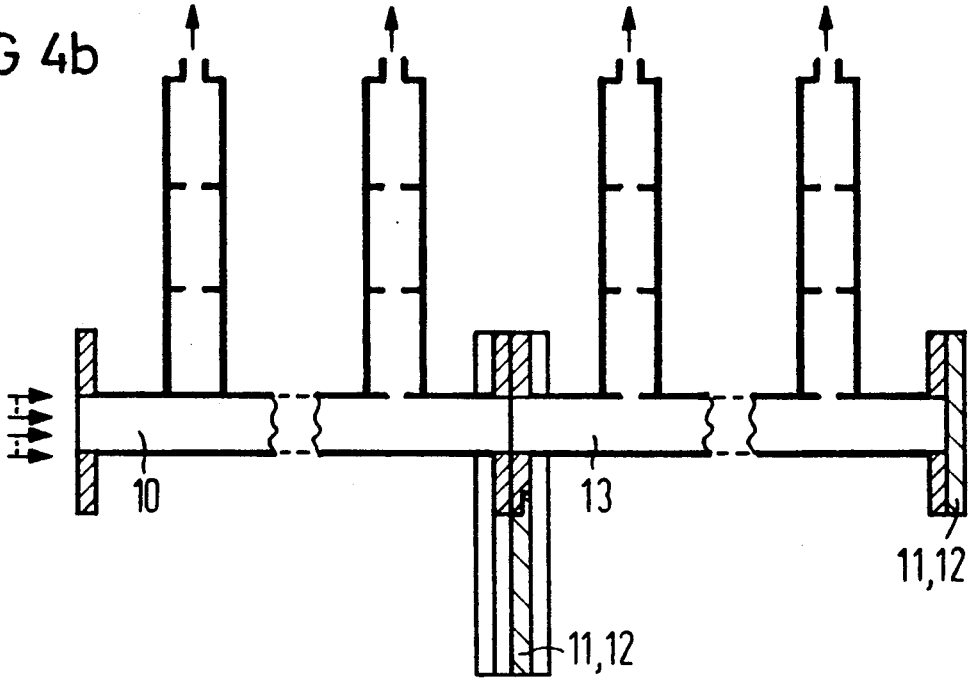

The analogous case applies to FIGS. 4*a* and 4*b*. A U-shaped rail 15 is provided therein instead of the carrier plate 14. The displacement possibility 17 is again indicated. The short circuit or reactive termination 11, 12 of the basic frequency separating filter unit 10 can be removed.

Figure 5A:
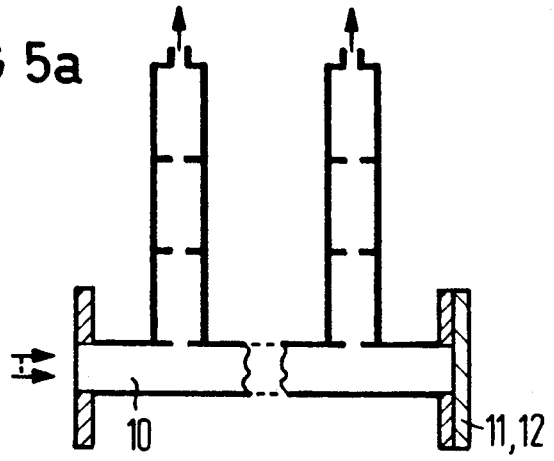
FIGS. 5*a*, 5*b*, and 5*c* illustrate an expansion 13 having short-circuit pins 20.
Figure 5B:
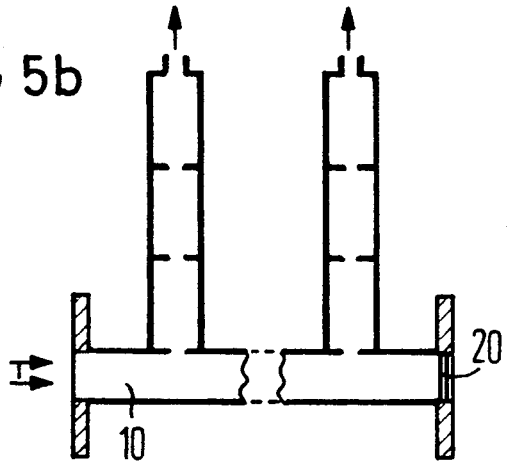

FIGS. 5*a, b, c* and $6a_1$–$6a_2$, $6b_1$–$6b_5$ show an expansion with short-circuit pins. FIG. $6a_1$–$a_2$, $6b_1$–$6b_3$ thereby shows the expansion in detail. FIGS. 5*a* and 5*b* show the basic frequency separating filter unit 10 that is terminated with the short circuit or reactive termination 11, 12.

Figure 5C:
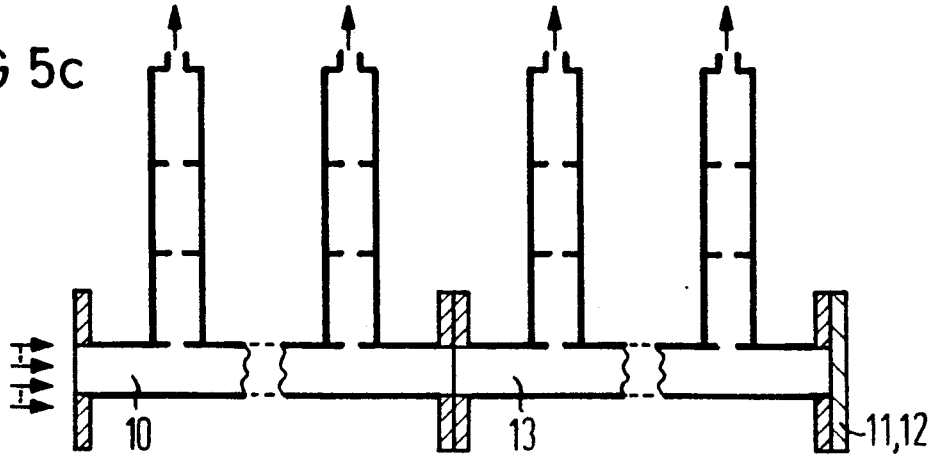

A short circuit pin 20 may be seen in FIG. 5*b*, this causing the short circuiting effect 11, 12 of FIG. 5*a* therein. The basic filter unit 10 and the expansion unit 13 that is terminated with a short circuit or reactive termination 11, 12 may be seen in FIG. 5*c*.

FIGS. $6a_1$, $6a_2$ and $6b_1$, $6b_2$ show the pins provided for the short circuit, the number thereof being capable of being selected from 1 through n, dependent on the requirements. FIGS. $6a_2$ and $6a_1$ show threaded pins 18 and the flange 19 pertaining thereto. FIGS. $6b_1$ and $6b_2$ show a pin plate 21 that is in turn equipped with the short circuit pins 1 . . . n and FIGS. $6b_3$ ad $6b_4$ show the flange 24 pertaining thereto. A coil spring 22 that presses balls 23 against the pin plate 21 may be seen in the detail in FIG. $6b_5$.

FIGS. 7*a*, 7*b*, and 7*c* show possibilities for introducing a short-circuit plate in detail. A rectangular waveguide flange is referenced with reference numeral 25. A slot 26 for a short-circuit plate 27 is introduced thereinto. The dimension of 0.5 mm is recited as an example of the slot width in the section taken along line 1—1 in FIG. 7 (FIG. 7*c*, in a scale of 20:1). The slot width, for example, can also amount to 0.5 mm.

Although various minor changes and modifications might be proposed by those skilled in the art, it will be understood that we wish to include within the claims of the patent warranted hereon all such changes and modifications as reasonably come within our contribution to the art.

We claim as our invention:

1. A GHz frequency range branch separating filter system, comprising:

a basic frequency separating filter unit formed of a feeder waveguide and at least one frequency channel filter extending from the waveguide, said waveguide having an input end and a termination end;

an expansion unit also having a feeder waveguide and at least one frequency channel filter extending form the waveguide, said waveguide having an input end and a termination end, and said expansion unit being designed so that when it is connected at said termination end of said basic frequency separating filter unit an electrical tuning of the basic filter is substantially preserved with both units coupled together;

a termination element at said termination end of said expansion unit;

means being provided for coupling the input end of the expansion unit to the termination end of the basic unit while the basic unit is in operation, without substantially disrupting said operation, and without emergence of hazardous microwave energy when coupling the units together during said operation; and said means comprising a slidable structure means mounted at the termination end of the basic unit for positioning a termination element at said termination end of said basic unit when the basic unit is being operated alone and for permitting a mechanically sliding removal of said termination element and a sliding into place of said expansion unit in alignment with said termination end of the basic unit when both the basic unit and the expansion unit are to be operated together in coupled fashion.

2. A system according to claim 1 wherein said slidable structure means comprises a flange at said termination end of said basic filter unit and a common carrier plate slidable along said flange, said common carrier plate having mounted thereon at a first location said termination element and at a laterally adjacent second location said input end of said expansion unit.

3. A system according to claim 1 wherein said slidable structure means comprises a flange mounted at said termination end of said basic filter unit, a flange at said input end of said expansion unit, a termination element laterally adjacent said flange at said input end of said expansion unit, and a channel-shaped member for receiving therein both said flange of said termination end basic filter unit and said flange of said expansion unit and laterally adjacent termination element such that said basic filter unit can be slid into position adjacent either said termination element or said flange at said input end of said expansion unit within said channel,.

4. A system according to claim 3 wherein said channel shaped member is U-shaped.

5. A system according to claim 1 wherein said termination element for said basic filter unit and said termination element for said expansion unit each comprise a short circuit termination.

6. A system according to claim 1 wherein said termination element for said basic filter unit and said termination element for said expansion unit each comprise a reactive termination.

7. A GHz frequency range branch separating filter system, comprising:

a basic frequency separating filter unit formed of a feeder waveguide and at least one frequency channel filter extending from the waveguide, said waveguide having an input end and a termination end;

an expansion unit also having a feeder waveguide and at least one frequency channel filter extending form the waveguide, said waveguide having an input end and a termination end, and said expansion unit being designed so that when it is connected at said termination end of said basic frequency separating filter unit an electrical tuning of the basic filer is substantially preserved with both units coupled together;

a termination element at said termination end of said expansion unit;

means being provided for coupling the input end of the expansion unit to the termination end of the basic unit while the basic unit is in operation, without substantially disrupting said operation, and without emergence of hazardous microwave energy when coupling the units together during said operation; and said means comprising slidable means of providing an selectively removable termination element at said termination end of said basic filer unit such that with the termination element in place, the basic filter unit can be operated and at the same time said expansion unit can be coupled at said termination end of said basic filter unit without disrupting the operation of the basic unit, said slidable means permitting said termination element to then be removed after said coupling so that without disrupting operation of the basic unit, both the expansion unit and the basic unit can then be operated together.

8. A system according to claim 7 wherein said slidable means termination element comprises a short circuit termination and is formed of at least one pin slidable into and out of an aperture provided in a flange mounted at said termination end of said basic filter unit.

9. A system according to claim 8 wherein a plurality of pins are provided.

10. A system according to claim 8 wherein a retaining means is provided within said aperture receiving said at least one pin.

11. A system according to claim 10 wherein said retaining means comprises a spring loaded ball protruding into said aperture.

12. A system according to claim 7 wherein said slidable means comprises a short circuit plate received within a lost in an end flange at said termination end of said basic unit.

* * * * *